US008723757B2

(12) United States Patent
Yusa

(10) Patent No.: US 8,723,757 B2
(45) Date of Patent: May 13, 2014

(54) VACUUM FLUORESCENT DISPLAY DRIVING APPARATUS

(75) Inventor: Atsushi Yusa, Tokyo (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 394 days.

(21) Appl. No.: 12/946,404

(22) Filed: Nov. 15, 2010

(65) Prior Publication Data

US 2011/0115775 A1 May 19, 2011

(30) Foreign Application Priority Data

Nov. 16, 2009 (JP) ..... 2009-261136

(51) Int. Cl.
*G09G 3/06* (2006.01)
*G09G 5/00* (2006.01)

(52) U.S. Cl.
USPC ..... 345/47; 345/211; 345/212

(58) Field of Classification Search
USPC ..... 345/47, 211, 212; 377/64–81
See application file for complete search history.

(56) References Cited

U.S. PATENT DOCUMENTS

| | | | | |
|---|---|---|---|---|
| 5,841,618 | A * | 11/1998 | Dilkes et al. | 361/110 |
| 2001/0053195 | A1* | 12/2001 | Yahiro | 377/76 |
| 2005/0200201 | A1* | 9/2005 | Jabaji et al. | 307/10.1 |

FOREIGN PATENT DOCUMENTS

| | | | | |
|---|---|---|---|---|
| JP | H04-247490 A | | 9/1992 | |
| JP | 06110399 A | * | 4/1994 | G09G 3/12 |
| JP | 2002-040991 A | | 2/2002 | |
| JP | 4106771 | | 4/2008 | |
| JP | 2009-258188 A | | 11/2009 | |

OTHER PUBLICATIONS

An Office Action; "Notice of Reasons for Rejection," issued by the Japanese Patent Office on Sep. 3, 2013, which corresponds to Japanese Patent Application No. 2009-261136 and is related to U.S. Appl. No. 12/946,404; with translation.

* cited by examiner

*Primary Examiner* — Vijay Shankar
*Assistant Examiner* — Mark Regn
(74) *Attorney, Agent, or Firm* — Studebaker & Brackett PC

(57) ABSTRACT

The present invention provides a vacuum fluorescent display driving apparatus and a vacuum fluorescent display driving method that may prevent generation of excessive load on power lines employed in driving, without causing an increase in size of the apparatus. The vacuum fluorescent display driving apparatus of the present invention includes, a grid driver that applies a driving voltage to plural grid electrodes respectively provided in the vacuum fluorescent display, and a grid driver limiting section that performs limitation on the number of grid electrodes to which voltage is applied simultaneously by the grid driver, to less than a predetermined first threshold value.

8 Claims, 6 Drawing Sheets

ANODE DATA LATCH SECTION
GRID DATA LATCH SECTION
16 LINES
10 LINES
CLOCK RESET
DECODER
RAM
8bit
CK
R
D
S
0
1
30
28
54
180
84-1
84-2
84-3
84-m
82
52-5
52-3
52-2
52-1
52
26
56-1
56-2
56-3
56-10
90-1
90-2
90-3
90-16
52'
52'-1
52'-2
52'-6
52'-12
70A
70B
70C
72
74
94
26'
61'
92-1
92-2
92-3
92-16
62-1
62-2
62-3
62-10
62-11
62-12
66-17
66-18
60
61
50
36
66-0
66-1
66-2
66-3
66-10
66-16
24

VACUUM FLUORESCENT DISPLAY DRIVING APPARATUS

CROSS-REFERENCE TO RELATED APPLICATION

This application claims priority under 35 USC 119 from Japanese Patent Application No. 2009-261136 filed on Nov. 16, 2009, the disclosure of which is incorporated by reference herein.

BACKGROUND OF THE INVENTION

1. Field of the Invention

The present invention relates to a vacuum fluorescent display driving apparatus. The present invention particularly relates to a driving apparatus employed with a vacuum fluorescent display having plural grid electrodes and anode electrodes.

2. Description of the Related Art

Vacuum fluorescent displays are employed as display elements for displaying an image. Vacuum fluorescent displays discharge electrons from a filament, and accelerate the discharged electrons by selectively applying voltage to grids and anodes, such that the electrons are irradiated onto fluorescent body provided to an anode.

A controller driver for vacuum fluorescent displays is described in Japanese Patent Application Laid-Open (JP-A) No. 2002-40991 having an object of reducing cost and increasing the degrees of freedom for design in this type of conventional vacuum fluorescent display. This vacuum fluorescent display controller driver includes Random Access Memory (RAM), a grid driver, an anode driver and a control section. The RAM stores display data input from outside. The grid driver scans the vacuum fluorescent display. The anode driver drives specific display segment electrodes. The control section supplies a driver signal to the grid driver and the anode driver. The control section includes a simple grid control section that simply scans the vacuum display, and a universal grid control section that enables plural grids to be selected at the same time. The control section repeats, a simple scan mode for simply scanning the grid, and a universal scan mode that selects and scans plural electrodes, according to a display pattern of the vacuum fluorescent display.

A display controller driver is described in JP-A No. 4106771 that facilitates diversity in display content. This display controller driver includes an interface, a decoder, display RAM, a grid driver, an anode driver, a control section and a timing generator. The interface performs transmission and reception of data with to and from a host computer. The decoder decodes command data and display data that has been input from the interface. The display RAM stores display data that has been separated by the decoder. The grid driver and the anode driver drives the display section based on the display data stored in the display RAM. The control section sets the driving method of the display section based on command data, and also reads out display data corresponding to this driving method from the display RAM. The timing generator supplies a timing signal to the interface, the decoder, the display RAM, the grid driver, the anode driver and the control section for setting the operation timing thereof. Grid data for forming a scanning signal corresponding to the driving method of the display section, and anode data corresponding to the display data, are stored in the display RAM. Each of these types of data are read out according to specific timing address, and are supplied to the anode driver or the grid driver via a latch circuit.

However, in the technologies described in JP-A No. 2002-40991 and JP-A No. 4106771, when a segment straddling plural grids is illuminated, driving power needs to be supplied simultaneously to plural grid electrodes connected to the plural grids. Accordingly, as the number increases of grid electrodes to which power is to be supplied simultaneously, excessive current flows in the power lines of the grid driver employed for driving. This results in a deterioration and/or melting and breaking of the power lines. Whilst the above can be rectified by increasing the thickness of the power lines, if the thickness of the power lines is simply increased this leads to a corresponding increase in size of the apparatus.

The above does not only occur in relation to the grid driver, but also occurs in relation to the anode driver.

SUMMARY OF THE INVENTION

The present invention provides a vacuum fluorescent display driving apparatus and a vacuum fluorescent display driving method that may prevent generation of excessive load on power lines employed in driving without causing an increase in size of the apparatus.

A first aspect of the present invention is a vacuum fluorescent display driving apparatus including: a voltage application section that, for a vacuum fluorescent display including a plurality of grids and a plurality of anodes, applies driving voltage to a plurality of grid electrodes connected to the grids and to a plurality of anode electrodes connected to the anodes; and a limiting section that performs at least one limitation selected from, a limitation on the number of the grid electrodes to which the voltage is applied simultaneously to less than a predetermined first threshold value, a limitation on the number of the anode electrodes to which the voltage is applied simultaneously to less than a predetermined second threshold value, and a limitation on the sum of the number of the grid electrodes and the number of the anode electrodes to which the voltage is applied simultaneously to less than a third threshold value.

According to the first aspect of the present invention, at least one limitation is performed by the limiting section out of a limitation on the number of the grid electrodes to which the voltage is applied simultaneously by the voltage application section to less than a predetermined first threshold value, a limitation on the number of the anode electrodes to which the voltage is applied simultaneously to less than a predetermined second threshold value, and/or a limitation on the sum of the number of the grid electrodes and the number of the anode electrodes to which the voltage is applied simultaneously by the voltage application section to less than a third threshold value.

Consequently, the first aspect of the present invention may prevent excessive load on power lines employed in driving without causing an increase in size of the apparatus.

In a second aspect of the present invention, in the first aspect, may further include a storage section pre-stored with necessity data expressing the necessity of voltage application to the grid electrodes and the anode electrodes, according to display contents with the vacuum fluorescent display, wherein the limiting section may perform the at least one limitation based on the necessity data that has been stored in the storage section. Accordingly, the second aspect of the present invention may prevent excessive load on the power lines more easily.

In a third aspect of the present invention, in the second aspect, based on the necessity data, the limiting section may, limit the number of the grid electrodes to which voltage is applied simultaneously to zero, when the number of the grid electrode to which the voltage is to be applied simultaneously by the voltage application section has become the first threshold value or greater, limit the number of the anode electrodes to which voltage is to be applied simultaneously to zero, when the number of the anode electrodes to which the voltage is to be applied simultaneously by the voltage application section has become the second threshold value or greater, and limit the number of the grid electrodes and the number of the anode electrodes to which voltage is to be applied simultaneously to zero, when the sum has become the third threshold value or greater. Accordingly, the third aspect of the present invention may prevent excessive load on the power lines.

In a fourth aspect of the present invention, in the third aspect, the limiting section may include, a selecting section that selects from the necessity data the necessity data corresponding to at least one of the grid electrodes and/or the anode electrodes subject to limitation one at a time, a latch section comprising serially connected latch circuits, the latch circuits numbering the same number as the threshold value and in the latch section a predetermined value is latched in sequence from the most upstream the latch circuits every time the selected necessity data is data expressing voltage application, and a gate section that interrupts application of the voltage to at least one of the grid electrodes and/or the anode electrodes subject to limitation when the predetermined value has been latched in the most downstream of the latch circuits of the latch section. Accordingly, the fourth aspect of the present invention may prevent excessive load on the power lines more easily.

In a fifth aspect of the present invention, in the above aspects, the first threshold value, the second threshold value and the third threshold value may be predetermined numbers according to a permissible current value of the power lines of the voltage application section used in driving. Accordingly, the fifth aspect of the present invention may prevent excessive load on the power lines.

In a sixth aspect of the present invention, in the fifth aspect, the first threshold value may be a predetermined number based on the size of current flowing in the power lines due to application of voltage to the grid electrodes, the second threshold value may be a predetermined number based on the size of current flowing in the power lines due to application of voltage to the anode electrodes, and the third threshold value may be a predetermined number based on the size of current flowing in the power lines due to application of voltage to the grid electrodes and to the anode electrodes. Accordingly, the sixth aspect of the present invention may prevent excessive load on the power lines with greater certainty.

In a seventh aspect of the present invention, in the above aspects, the limiting section may not perform limitation in cases where the number of grid electrodes to which the voltage is applied simultaneously by the voltage application section is the first threshold value or lower, the number of anode electrodes to which the voltage is applied simultaneously by the voltage application section is the second threshold value or lower, and the sum is the third threshold value or lower. Accordingly, the seventh aspect of the present invention may apply driving voltage to the grid electrodes and the anode electrode when the number of the grid electrodes and the anode electrodes to which voltage is applied simultaneously are the threshold values or lower.

In an eighth aspect of the present invention, in the above aspects, the vacuum fluorescent display may be configured to display an image straddling a plurality of grids. Accordingly, the eighth aspect of the present invention may prevent excessive load on the power lines irrespective of the configuration of images displayed.

A ninth aspect of the present invention is a driving method for a vacuum fluorescent display including a plurality of grids, a plurality of anodes, and a voltage application circuit that applies driving voltage to a plurality of grid electrodes connected to the grids and to a plurality of anode electrodes connected to the anodes, the driving method including: performing at least one limitation selected from a limitation on the number of the grid electrodes to which the voltage is applied simultaneously to less than a predetermined first threshold value, a limitation on the number of the anode electrodes to which the voltage is applied simultaneously to less than a predetermined second threshold value, and a limitation on the sum of the number of the grid electrodes and the number of the anode electrodes to which the voltage is applied simultaneously to less than a third threshold value.

According to the ninth aspect of the present invention, at least one limitation is performed from, a limitation on the number of the grid electrodes to which the voltage is applied simultaneously to less than a predetermined first threshold value, a limitation on the number of the anode electrodes to which the voltage is applied simultaneously to less than a predetermined second threshold value, and/or a limitation on the sum of the number of the grid electrodes and the number of the anode electrodes to which the voltage is applied simultaneously to less than a third threshold value. Consequently, the ninth aspect of the present invention may prevent excessive load on power lines employed in driving without causing an increase in size of the apparatus.

In a tenth aspect of the present invention, in the above ninth aspect, the first threshold value, the second threshold value and the third threshold value may be predetermined numbers according to a permissible current value of power lines of the voltage application circuit used in driving. Accordingly, excessive load on power lines may be prevented with greater certainty.

According to the present invention, excessive load on power lines employed in driving may be prevented without causing an increase in size of the apparatus.

BRIEF DESCRIPTION OF THE DRAWINGS

Exemplary embodiments of the present invention will be described in detail based on the following figures, wherein.

DETAILED DESCRIPTION OF THE INVENTION

Detailed explanation follows regarding exemplary embodiments of the present invention, with reference to the drawings.

First Exemplary Embodiment

Figure 1:
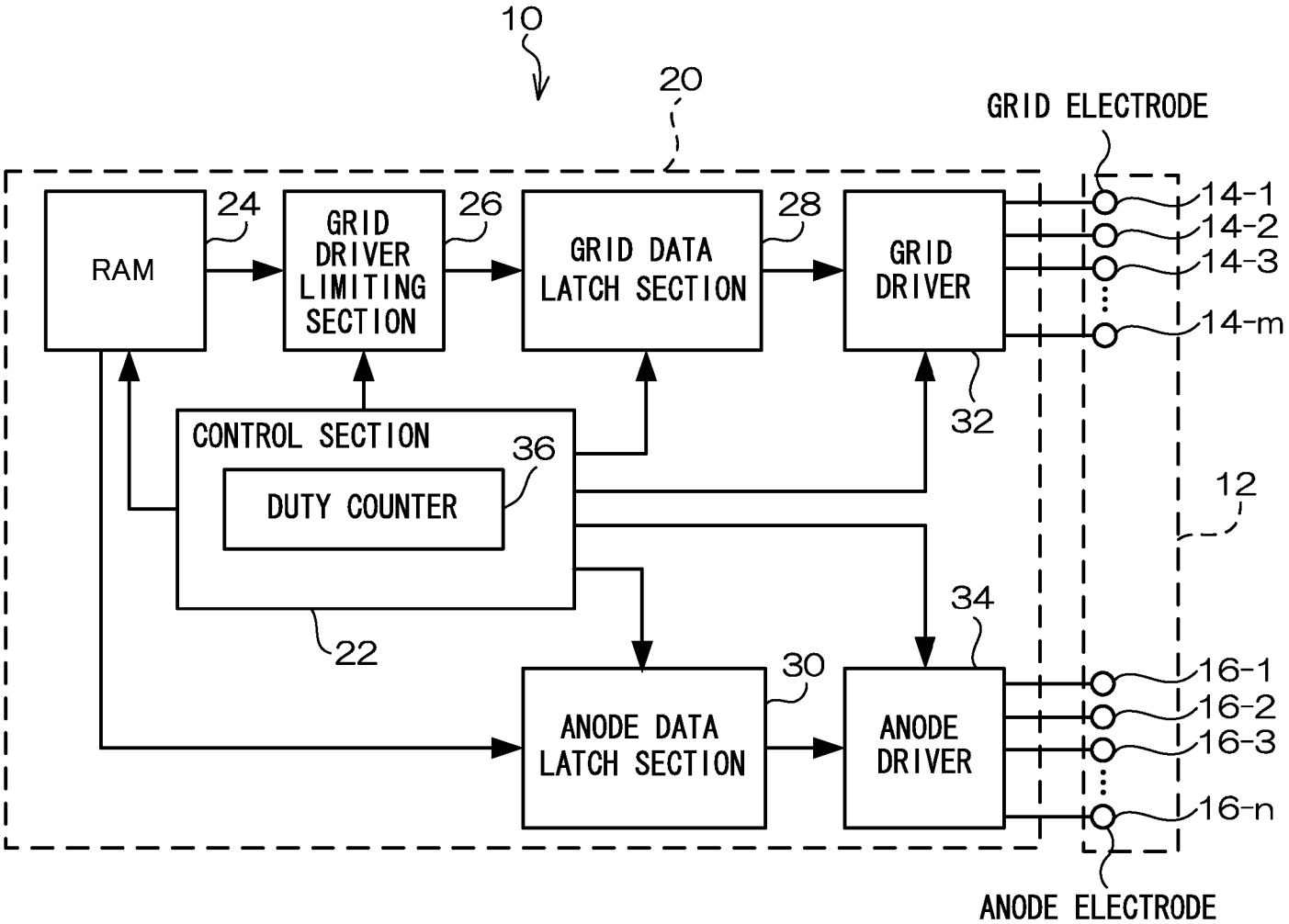
FIG. 1 is a block diagram showing a configuration of a vacuum fluorescent display driving apparatus according to a first exemplary embodiment.

FIG. 1 shows a configuration of a vacuum fluorescent display apparatus (referred to below as "display apparatus") 10 according to a present exemplary embodiment.

As shown in FIG. 1, the display apparatus 10 according to the present exemplary embodiment is configured including a fluorescent display section 12 and a controller driver 20.

The fluorescent display section 12 according to the present exemplary embodiment includes grid electrodes 14-1 to **14-*m* (wherein "m" is the number of grid electrodes) connected to corresponding respective grids, and anode electrodes 16-1 to 16-*n* (wherein "n" is the number of anode electrodes) connected to corresponding respective anodes. In the explanation below, reference will be made with suffixes 1 to m applied to the reference numeral representing the grid electrode when discrimination is made between each of the grid electrodes 14-1 to 14-*m*, as above. However, reference will be made to grid electrodes 14 when no discrimination is made between each of the grid electrodes 14-1 to 14-*m*. Similarly, in the explanation below, reference will be made with suffixes 1 to n applied to the reference numeral representing the anode electrode when discrimination is made between each of the anode electrodes 16-1 to 16-*n*, as above. However, reference will be made to anode electrodes 16 when no discrimination is made between each of the anode electrodes 16-1 to 16-*n*. Note that the number m of the grid electrodes 14 and the number n of the anode electrodes 16** may be the same as each other or different from each other.

The controller driver 20 includes a control section 22 and RAM 24. The control section 22 controls the overall operation of the controller driver 20. The RAM 24 is stored in advance with grid data expressing the necessity of applying voltage to the grid electrodes 14, and anode data expressing the necessity of applying voltage to the anode electrodes 16, according to contents for display using the fluorescent display section 12.

The controller driver 20 includes a grid driver limiting section 26, a grid data latch section 28 and a grid driver 32. The grid driver limiting section 26 limits the number of grid electrodes 14 to which voltage is simultaneously applied by the grid driver 32 to less than a predetermined threshold value. The grid data latch section 28 is input with grid data that has been output from the RAM 24. Furthermore, the grid data latch section 28 first latches (holds) the input grid data, then transmits the latched grid data to the grid driver 32. The grid driver 32 applies a voltage for driving the grid electrodes 14 provided to the fluorescent display section 12, based on the grid data output from the grid data latch section 28.

The controller driver 20 includes an anode data latch section 30 and an anode driver 34. The anode data latch section 30 is input with the anode data that has been output from the RAM 24. Furthermore, the anode data latch section 30 first latches the output anode data then transmits the latched grid data to the anode driver 34. The anode driver 34 applies a voltage for driving to the anode electrodes 16 provided to the fluorescent display section 12, based on the anode data output from the anode data latch section 30.

The control section 22, for example, includes a duty counter 36 that repeatedly counts values for 0 (zero) to 255. The grid driver limiting section 26, the grid data latch section 28, and the anode data latch section 30 are controlled according to the count values output from the duty counter 36. The duty counter 36 controls the driving duration of the grid driver 32 and the anode driver 34 (namely, the duration of voltage application to the grid electrodes 14 and the anode electrodes 16) based on the count value for output, and performs brightness adjustment of the fluorescent display section 12.

The controller driver 20 stores in the RAM 24 as grid data "1" and "0" for each of the grid electrodes 14 and for each display contents. "1" expresses the application of voltage to the corresponding grid electrode 14 and "0" expresses no application of voltage thereto. In a similar manner, the controller driver 20 stores in the RAM 24 as anode data "1" and "0" for each of the anode electrodes 16 and for each display contents. "1" expresses the application of voltage to the corresponding anode electrode 16 and "0" expresses no application of voltage thereto.

Figure 4:
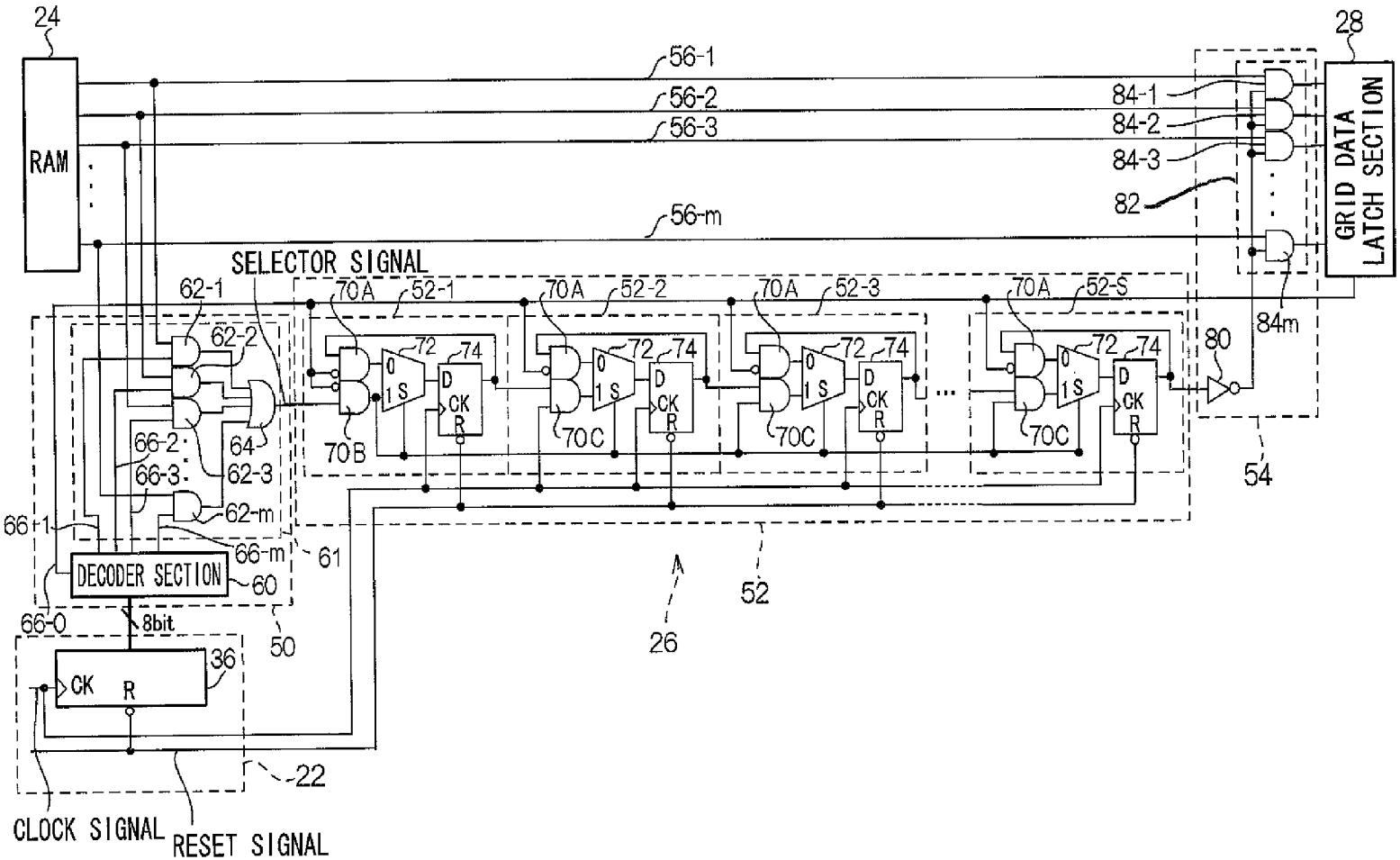
FIG. 4 is a circuit diagram showing a configuration of a grid driver limiting section according to the first exemplary embodiment.

Note that the grid driver limiting section 26 is configured as a digital circuit as shown in FIG. 4. "1" in the digital circuit corresponds to High Level and "0" corresponds to Low Level in the digital circuit.

When the number of grid electrodes 14 to which voltage is simultaneously applied by the grid driver 32 has become a predetermined threshold value or greater, the grid driver limiting section 26 limits the number of grid electrodes 14 to which voltage is simultaneously applied to less than the predetermined threshold value (to zero in the present exemplary embodiment).

Note that the threshold value is a predetermined number according to the permissible current value of the power lines of the grid driver 32. Specifically, the threshold value is determined based on the size of the current flowing in the power lines due to the voltage applied to the grid electrodes 14.

Note that in the present exemplary embodiment, the threshold value is determined such that the current flowing in the power lines due to application of voltage to the grid electrodes 14 is the permissible current value of the power lines or lower.

Figure 2:
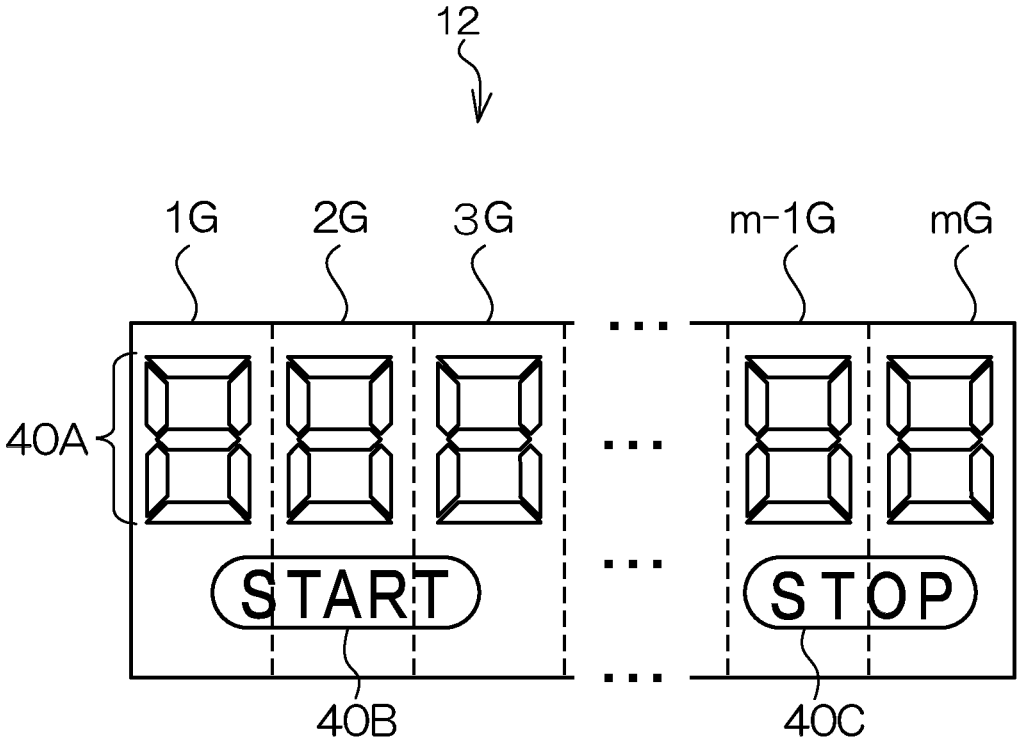
FIG. 2 is a block diagram showing a configuration of a fluorescent display section according to the first exemplary embodiment.

FIG. 2 shows the fluorescent display section 12 according to the present exemplary embodiment.

As shown in FIG. 2, the fluorescent display section 12 is configured including a segment 40A expressing a number of characters or letters of the alphabet, a graphic 40B expressing "START", and a graphic 40C expressing "STOP". Note that there is no limitation thereto and the vacuum fluorescent display may be configured with images such as dots, symbols, other graphics or the like. There are also grids 1G to mG provided to the fluorescent display section 12, corresponding to each of the segments 40.

The reference numbers of the grids 1G to mG and the reference numbers of the grid electrodes 14-1 to **14-*m* correspond to the connection relationships between each of the grids and the grid electrodes. For example, the grid 1G is connected to the grid electrode 14-1 and the grid 2G is connected to the grid electrode 14-2, and the grid mG is connected to the grid electrode 14-*m***.

The graphic 40B straddles the grids 1G to 3G, the graphic 40C straddles the grid m-1G and the grid mG. Namely, to display graphic 40B, the grid driver 32 applies a voltage simultaneously to the three grids 1G to 3G. In a similar manner, to display graphic 40C, the grid driver 32 applies a voltage simultaneously to the two grid m-1G and grid mG. Note there is no limitation to graphics straddling two or three grids, and configuration may be made with graphics straddling four or more grids.

Figure 3:
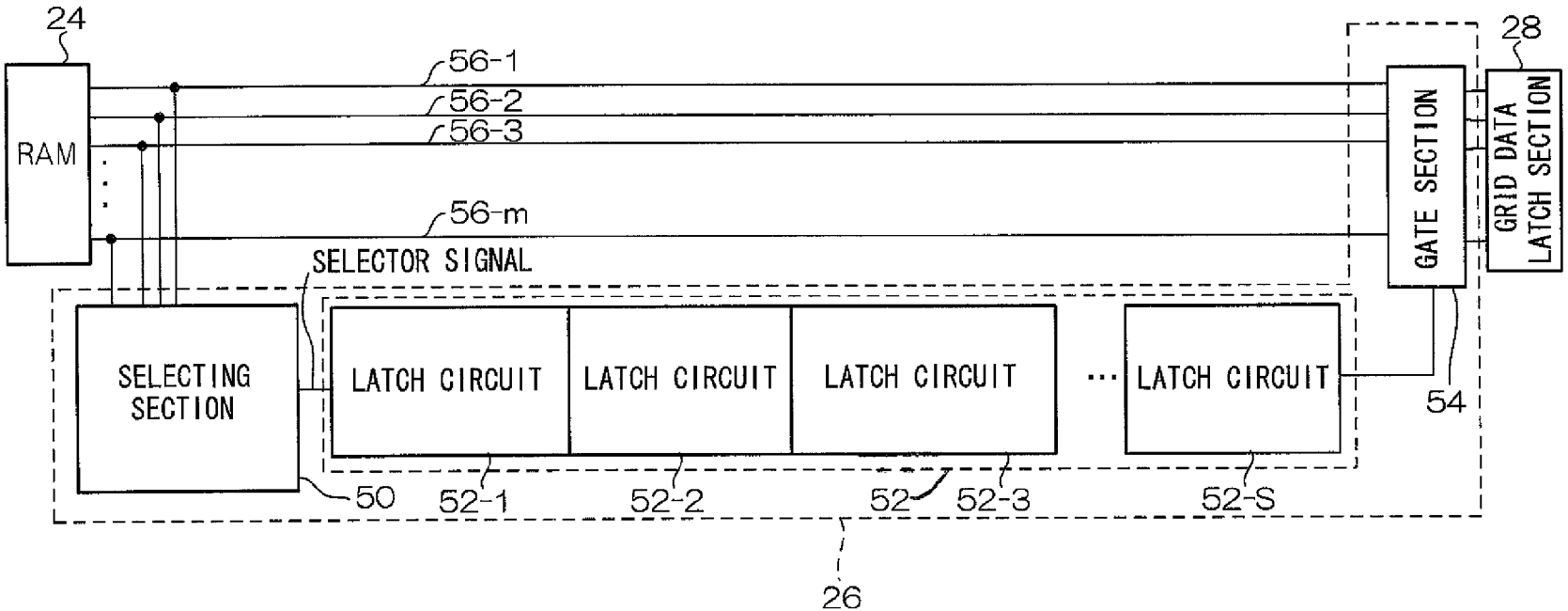
FIG. 3 is a block diagram showing a configuration of a grid driver limiting section according to the first exemplary embodiment.

Explanation follows of a configuration of the grid driver limiting section 26, with reference to FIG. 3.

As shown in FIG. 3, the grid driver limiting section 26 includes a selecting section 50 and a gate section 54 that are connected via wiring lines (referred to below as "grid data lines") 56-1 to **56-*m* connected to output terminals of the RAM 24 for outputting grid data, and a latch section 52 disposed between the selecting section 50 and the gate section 54**.

The selecting section 50 selects one at a time from plural grid data, corresponding to each of the respective grid electrodes 14 and output from the RAM 24 via the grid data lines 56-1 to **56-*m*, and successively outputs to the latch section 52. The value of the suffixes of the grid data lines 56-1 to 56-*m* corresponds to the value of the reference numbers of the grid electrodes 14-1 to 14-*m*. For example, the grid data transmitted by the grid data line 56-1 corresponds to the grid electrode 14-1, the grid data transmitted by the grid data line 56-2 corresponds to the grid electrode 14-2, and the grid data transmitted by the grid data line 56-*m* corresponds to the grid electrode 14-*m***.

The latch section 52 is configured with plural serially connected latch circuits 52-1 to **52-*s*. In the latch section 52 High Level is latched in sequence from the most upstream latch circuit 52-1 every time the signal output from the selecting section 50** (referred to below as the "select signal") is "1", equivalent to High Level.

The gate section 54 interrupts output of grid data from the RAM 24 to the grid data latch section 28 when the most downstream latch circuit **52-*s* is latched to High Level. The gate section 54 continues to output grid data to the grid data latch section 28 as long as the latch circuit 52-*s*** is latched to Low Level.

Accordingly, the number s of the latch circuits provided to the latch section 52 is a threshold value for switching between output of grid data to the grid data latch section 28 and stopping output thereof. Consequently, the number s of the latch circuits needs to be a number that is one more than the upper limit number of the number of grid electrodes 14 that may be simultaneously applied with driving voltage.

Next explanation follows regarding a specific circuit configuration of the grid driver limiting section 26 according to the present exemplary embodiment.

As shown in FIG. 4, the selecting section 50 includes a decoder 60 and a selector circuit 61.

The decoder 60 decodes a count value output from the duty counter 36 and outputs a decode signal corresponding to the count value.

Note there are output terminals 66-0 to **66-*m* provided in the decoder 60 for outputting a decode signal corresponding to the count value that is the same value as the value of the suffix to each of their respective reference numerals. The output terminal 66-0 is connected to each of the latch circuits 52-1 to 52-*s* and the grid data latch section 28. The output terminals 66-1 to 66-*m* are connected to the selector circuit 61**.

The duty counter 36 includes a clock signal input terminal that is input with a clock signal of predetermined cycle, and a reset signal input terminal that is input with a reset signal. The duty counter 36 synchronizes to the input clock signal and outputs the count value from its output terminal to the input terminal of the decoder 60.

The selector circuit 61 includes two-input AND circuits 62-1 to **62-*m*, this being the same number m as the m grid electrodes 14 and an m-input OR circuit 64**.

One of the input terminals of each of the AND circuits 62-1 to **62-*m* is connected to the respective grid data line 56-1 to 56-*m* having the same value as the suffix of the reference numeral. The other input terminal of each of the AND circuits 62-1 to 62-*m* is connected to the respective output terminal 66-1 to 66-*m* of the decoder 60** having the same value as the suffix of the reference numeral.

The output terminals of the AND circuits 62-1 to **62-*m* are connected separately to individual input terminals of the respective OR circuits 64. When a signal of High Level is output from at least one of the output terminals of the AND circuits 62-1 to 62-*m*, a selector signal output from the OR circuit 64 is High Level. However, when all of the output terminals of the AND circuits 62-1 to 62-*m*** are Low Level, the selector signal becomes Low Level.

The output terminal of the OR circuit 64 is connected to the input terminal of the latch circuit 52-1 that is positioned most upstream in the latch section 52. As a result thereof, the selector signal is input to the latch circuit 52-1.

Next, explanation follows of a configuration of the latch circuits 52-1 to **52-*s***.

The latch circuit 52-1 includes two-input AND circuits 70A, 70B each having one input terminal which is a negative logic terminal, a two-input one-output selector circuit 72, and a D flip-flop circuit 74.

The negative logic terminals of the AND circuits 70A, 70B of the latch circuit 52-1 are connected to the output terminal 66-0 of the decoder 60. The output terminal of the OR circuit 64 is connected to the other input terminal of the AND circuit 70B. The output terminal of the AND circuit 70A is connected to one of the input terminals of the selector circuit 72. The output terminal of the AND circuit 70B is connected to the other input terminal of the selector circuit 72 and is connected to the selector terminal S of the selector circuit 72.

The output terminal of the selector circuit 72 is connected to the D input terminal of the D flip-flop circuit 74.

The output terminal of the D flip-flop circuit 74 is connected to the input terminal of the latch circuit 52-2 and is also connected to the input terminal of the AND circuit 70A that is not the negative logic terminal. The clock signal is input to the clock terminal CK of the D flip-flop circuit 74. A reset signal is input to a reset terminal R of the D flip-flop circuit 74.

When the clock signal is input together with the selector signal being at High Level, the latch circuit 52-1 outputs a High Level signal to the latch circuit 52-2 at the timing when the next clock signal has been input. When a High Level signal has been input from the output terminal 66-0 and the reset signal has been input, the latch circuit 52-1 according to the present exemplary embodiment clears the signal that is being latched.

The latch circuit 52-2, similarly to the latch circuit 52-1, includes an AND circuit 70A, an AND circuit 70C, a selector circuit 72 and a D flip-flop circuit 74.

The output terminal 66-0 of the decoder 60 is connected to the negative logic terminal of the AND circuit 70A of the latch circuit 52-2. The output terminal of the latch circuit 52-1 is connected to one of the input terminals of the AND circuit 70C. The clock signal is input to the other input terminal of the AND circuit 70C. The output terminal of the AND circuit 70A is connected to one of the input terminals of the selector circuit 72. The output terminal of the AND circuit 70C is connected to the other of the input terminals of the selector circuit 72. The output terminal of the AND circuit 70B of the latch circuit 52-1 is connected to a selector terminal S of the selector circuit 72 in the latch circuit 52-2.

Since the connection relationships between the D flip-flop circuit 74 of the latch circuit 52-2, such as the selector circuit 72 and the like, are similar to those of the D flip-flop circuit 74 of the latch circuit 52-1, and therefore further explanation thereof will be omitted.

The latch circuits 52-3 to **52-*s* are configured similarly to the latch circuit 52-2. The output terminal of the most downstream latch circuit 52-*s*, namely the output terminal of the D flip-flop circuit 74 provided in the latch circuit 52**-*s*, is connected to the input terminal of the gate section 54.

Next, explanation follows regarding configuration of the gate section 54.

The gate section 54 according to the present exemplary embodiment includes an inverter circuit 80 and a gate circuit 82.

The input terminal of the inverter circuit 80, connected to the output terminal of the latch circuit 52-*s*, inverts the input signal from the latch circuit 52-*s* and outputs to a gate circuit 82.

The gate circuit 82 includes two-input AND circuits 84-1 to 84-*m*, these being of the same number m as the grid electrodes 14. One of the input terminals of the AND circuits 84-1 to 84-*m* is connected to the respective grid data line 56-1 to 56-*m* having the same value for the suffix to the reference numeral, and the other input terminal is connected to the output terminal of the inverter circuit 80. The output terminals of the AND circuits 84-1 to 84-*m* are connected to the grid data latch section 28.

Figure 5:
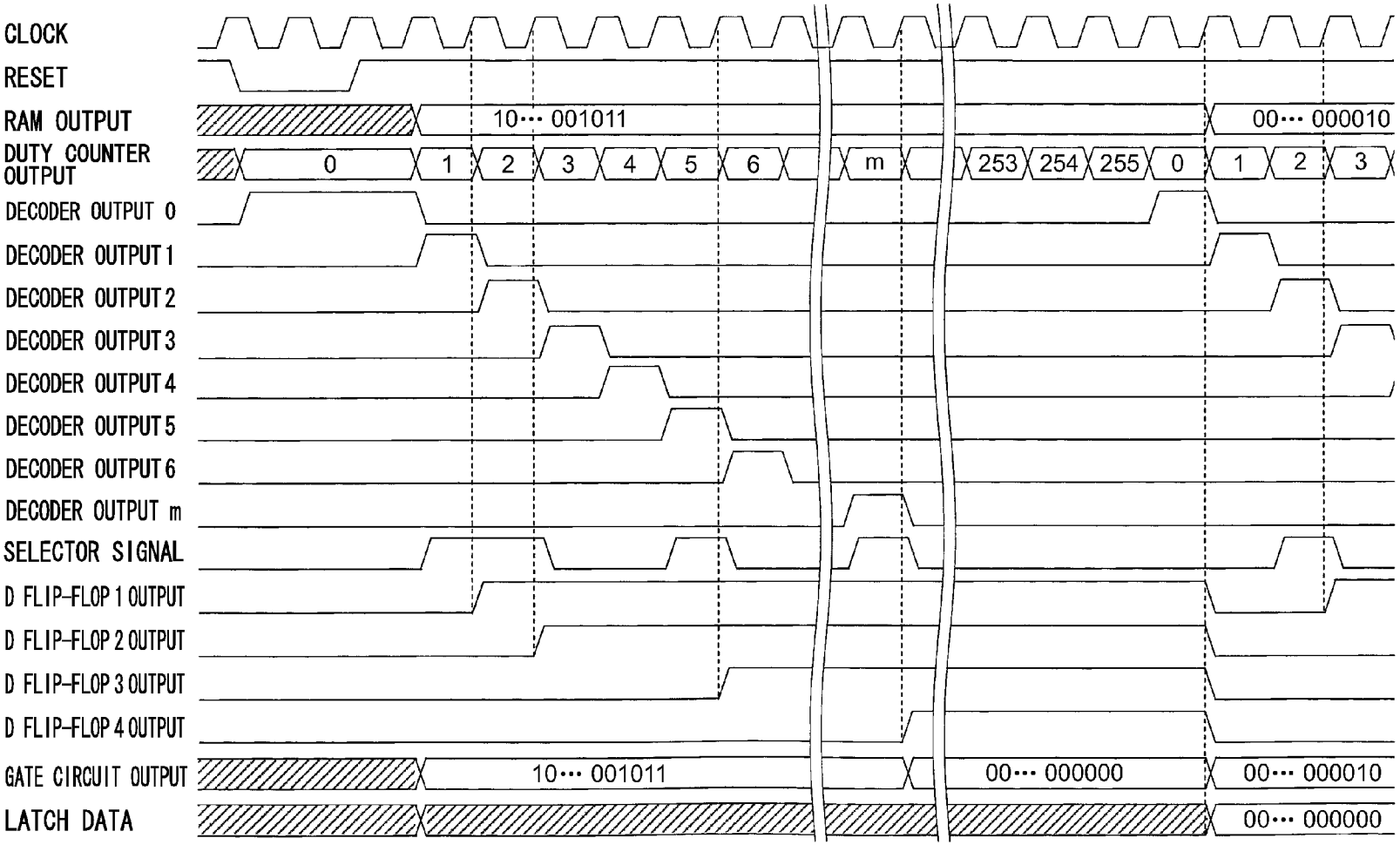
FIG. 5 is a diagram showing an example of a timing chart related to operation of a grid driver limiting section according to the first exemplary embodiment.

Next, as shown in FIG. 5, explanation follows regarding the application of driving voltage to the grid electrodes 14 when performing display with the fluorescent display section 12 of the present exemplary embodiment. Note that explanation is of a case in the present exemplary embodiment where the latch section 52 has four latch circuits 52-1 to 52-4.

The control section 22 synchronizes to the clock signal and makes the reset signal adopt the state during reset (Low Level in the present exemplary embodiment). In response thereto, the duty counter 36 starts to count from zero synchronizes to the clock signal.

Next, the control section 22 starts operation to read out from the RAM 24 grid data according to the display contents with the fluorescent display section 12 (referred to below as "grid data for display") in a synchronized state with the count from the duty counter 36.

The decoder 60 of the selecting section 50 outputs a decode signal according to the count value being input from the duty counter 36. In response thereto, each of the AND circuits 62-1 to 62-*m* outputs grid data corresponding to separate individual respective grid electrodes 14 (referred to below as "individual grid data") in sequence one at a time in synchronization with the clock signal. As a result thereof, the individual grid data corresponding to each of the grid electrodes 14 is serially output from the OR circuit 64 as a selector signal in a synchronized state with the clock signal.

Every time the selector signal in the latch section 52 is "1", corresponding to High Level, High Level is latched by each of the D flip-flop circuits 74 in sequence from the most upstream latch circuit 52-1. At the point in time when the numbers of "1" in the grid data corresponding to High Level, is the same number as the number of latch circuits, High Level is latched in the most downstream latch circuit 52-4.

Individual grid data corresponding to one of the input terminals of the AND circuits 84-1 to 84-*m* is input from the RAM 24 to the gate section 54. Furthermore, the signal output from the most downstream latch circuit 52-4 in the latch section 52 is input via the inverter circuit 80 to the other input terminals of the AND circuits 84-1 to 84-*m*. Accordingly, when the signal output from the latch circuit 52-4 is High Level (namely, when the number of grid electrodes 14 simultaneously applied with voltage is the number of latch circuits or greater), application of voltage to the grid electrodes 14 by the grid driver 32 is interrupted. However, when the signal output from the latch circuit 52-4 is Low Level (namely, when the number of grid electrodes 14 simultaneously applied with voltage is less than the number of latch circuits), application of voltage by the grid driver 32 to the grid electrodes 14 is performed.

When the duty counter 36 has overflowed, the grid data latch section 28 latches the grid data for display input via the gate circuit 82. The D flip-flop circuits 74-1 to 74-*m* reset the signal being latched. Furthermore, the control section 22 switches over the grid data for display output from the RAM 24 to the next grid data for display.

For example, when the grid data stored in the grid driver 32 is, as shown in FIG. 5, "10 . . . 001011" (wherein " . . . " are all "0", and the highest position is the $m^{th}$ bit), the individual grid data corresponding to the grid electrodes 14-1, 14-2, 14-4, 14-*m* is "1". Consequently, the selector signal is High Level every time the duty counter 36 counts "1", "2", "4", "m". Every time the selector signal is High Level, a High Level signal is latched in sequence from the most upstream latch circuit 52-1 to the latch circuit 52-4.

When a High Level signal is output from the latch circuit 52-4, a Low Level signal is output from the inverter circuit 80. As a result thereof, the signals output from AND circuits 84-1 to 84-*m* provided in the gate circuit 82 all becomes Low Level ("00 . . . 000000").

Then, when the duty counter 36 overflows, the grid data latch section 28 latches the grid data for display that has become "00 . . . 000000" due to the gate circuit 82. Next, the D flip-flop circuits 74-1 to 74-4 reset the signal being latched. Furthermore, the control section 22 switches over the grid data for display output from the RAM 24 to the next grid data for display "00 . . . 000010".

Due thereto, when the number of the grid electrodes 14 to be simultaneously applied with voltage is 4 or greater, the number of grid electrodes 14 to which voltage is simultaneously applied can be made zero. However, in the present exemplary embodiment, excessively large load on the power lines may be prevented without increasing the size of the display apparatus 10.

Second Exemplary Embodiment

In the present second exemplary embodiment, configuration is made such that sum of the number of grid electrodes 14 and the number of anode electrodes 16 to which voltage is simultaneously applied is less than a predetermined threshold value.

Figure 6:
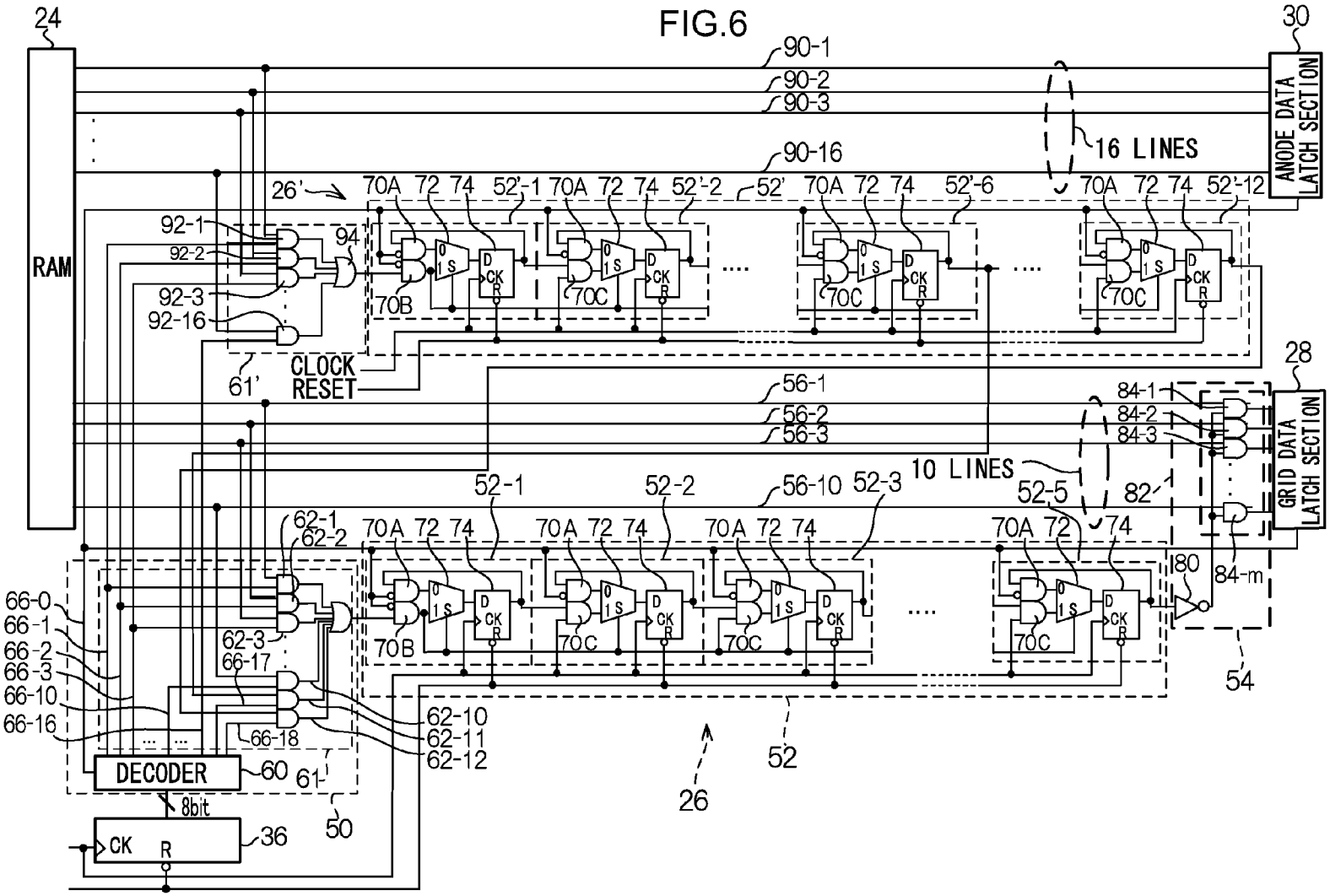
FIG. 6 is a circuit diagram showing a configuration of a grid driver limiting section according to a second exemplary embodiment.

FIG. 6 is a diagram showing a circuit configuration of a grid driver limiting section 26 and an anode driver limiting section 26' according to the second exemplary embodiment. For configuration similar to that of the grid driver limiting section 26 of the first exemplary embodiment, the same reference numerals are appended and explanation thereof is omitted. As an example, explanation follows of a case where the number of grid electrodes 14 is 10, and the number of anode electrodes 16 is 16.

The anode driver limiting section 26' includes a selector circuit 61' connected to output terminals of the RAM 24 outputting anode data through connection lines (referred to below as "anode data lines") 90-1 to 90-16, and a latch section 52'.

The selector circuit 61 is equipped with two-input AND circuits 92-1 to 92-16, and an OR circuit 94. One of the input terminals of the AND circuits 92-1 to 92-16 is connected to the anode data line 90-1 to 90-16 that has the same value for the suffix of the reference numeral. The other input terminal of the AND circuits 92-1 to 92-16 is connected to respective output terminals 66-1 to 66-16 of the decoder 60.

The latch section 52' includes, as an example, plural (12 in the present second exemplary embodiment) latch circuits 52'-1 to 52'-12. The output terminal of the latch section 52'-6 is connected to the input terminal of the latch section 52'-7, and also is connected to the selector circuit 61 of the selecting section 50 provided in the grid driver limiting section 26. The output terminal of the latch section 52'-12 is connected to the selector circuit 61.

AND circuits 62-1 to 62-12 are provided in the selector circuit 61 of the grid driver limiting section 26. One of the input terminals of the AND circuits 62-1 to 62-10 is connected to the grid data lines 56-1 to 56-10 having the same value for the suffix of the reference numeral. The other input terminal of the AND circuits 62-1 to 62-10 is connected to the respective output terminal 66-1 to 66-10 of the decoder 60. One of the input terminals of the AND circuit 62-11 is connected to the output terminal of the latch section 52'-6, and the other input terminal thereof is connected to the output terminal 66-17 of the decoder 60. Furthermore, one of the input terminals of the AND circuit 62-12 is connected to the output terminal of the latch section 52'-12 and the other input terminal thereof is connected to the output terminal 66-18 of the decoder 60.

In the second exemplary embodiment, as an example, the current flowing in the power lines of the controller driver 20 due to application of voltage to a single grid electrode 14 is 30 mA, the current flowing in the power lines of the controller driver 20 due to application of voltage to a single anode electrode 16 is 5 mA, and the permissible current value of the power lines of the controller driver 20 is up to 150 mA. Therefore, in order to make the maximum number of grid electrodes 14 to which voltage can be simultaneously applied four, the number of latch circuits of the grid driver limiting section 26 is set at five.

According to the configuration as described above, when the number of anode data elements that are "1" is 6 or more, the signal output from the latch section 52'-6 is High Level. Furthermore, when the number of anode data elements that are "1" is 12 or more, the signal output from the latch section 52'-12 is High Level. The number of "1" of the grid data is handled in a similar manner in order to select with the selector circuit 61 of the grid driver limiting section 26 at timings when the duty counter 36 has a count value of "17", "18". Namely, the sum of the grid electrodes 14 and the anode electrodes 16 to which voltage is simultaneously applied is limited to less than a predetermined threshold value.

Then, in a case in which voltage is applied simultaneously to 6 of the anode electrodes 16 and voltage is applied simultaneously to 4 of the grid electrodes 14, the signals output from gate circuits 92 are all Low Level. As a result, application of voltage by the grid driver 32 to the grid electrodes 14 is limited. Furthermore, in cases where voltage is applied simultaneously to 12 of the anode electrodes 16 and voltage is applied simultaneously to 3 of the grid electrodes 14, the signals output from the gate circuits 92 are all Low Level, and application of voltage by the grid driver 32 to the grid electrodes 14 is limited.

The present invention has been explained by way of each of the above exemplary embodiments. However, the technical scope of the present invention is not limited to the descriptions of each of the exemplary embodiments above.

For example, in each of the above exemplary embodiments, explanation is of cases in which only limitation is made to the number of grid electrodes 14 and/or anode electrodes 16 to which voltage is applied simultaneously, however, the present invention is not limited thereto. In an alternative exemplary embodiment, configuration may be made such that in addition to limitation itself, the fact that limitation has been executed is notified. In this alternative exemplary embodiment, the usability of the display apparatus 10 can be raised.

Furthermore, in each of the above exemplary embodiment, explanation is of cases in which, for the numbers of grid electrodes 14 and/or anode electrodes 16 to which voltage is applied simultaneously, limitation to zero is applied as the limitation. However, the present invention is not limited thereto. In an alternative exemplary embodiment, for example, configuration may be made such that the number of grid electrodes 14 and/or anode electrodes 16 to which voltage is simultaneously applied is made 1 or more, and less than a predetermined threshold value. Similar effects are obtained by this alternative exemplary embodiment to those of the above exemplary embodiments.

Furthermore, explanation is of cases in the first exemplary embodiment where only the grid electrodes 14 are subject to limitation, and in the second exemplary embodiment both the grid electrodes 14 and the anode electrodes 16 are subject to limitation. However, the present invention is not limited thereto. In an alternative exemplary embodiment, for example, configuration may be made such that only the anode electrodes 16 are subject to limitation. Similar effects are obtained by this alternative exemplary embodiment to those of the above exemplary embodiments.

Furthermore, in the second exemplary embodiment, explanation is of cases in which only voltage application to the grid electrodes 14 is interrupted when the sum of the number of grid electrodes 14 and anode electrodes 16 to which voltage is simultaneously applied is the predetermined threshold value or greater. However, the present invention is not limited thereto. In an alternative exemplary embodiment, for example, configuration may be made such that under such circumstances voltage application is interrupted to both the grid electrodes 14 and the anode electrodes 16. In this alternative exemplary embodiment, excessively large load on the power lines is prevented.

In each the above exemplary embodiments, explanation is of a case in which the grid driver limiting section 26 and/or the anode driver limiting section 26' are configured by a selecting section, a latch section and a gate section. However, the present invention is not limited thereto. Application may be made to various configurations as long as they are configurations in which limitation can be made to at least one of the numbers of electrodes to which voltage is applied simultaneously, namely the number of grid electrodes 14 and/or the number of anode electrodes 16.

Furthermore, in each of the above exemplary embodiments, explanation is of cases in which the present invention is realized by means of hardware. However, the present invention is not limited thereto, and the present invention may be realized using software, or in an embodiment realized through a combination of both hardware and software. Similar effects are obtained thereby to those of the above exemplary embodiments.

What is claimed is:

1. A vacuum fluorescent display driving apparatus comprising:

a control driver to apply a driving voltage simultaneously to a plurality of grid electrodes of a vacuum fluorescent display through a power line; and a selecting section;

wherein the control driver includes a grid driver limiting section to perform a limitation on the number of the grid electrodes to which the driving voltage is applied simultaneously to less than a predetermined first threshold value, the predetermined first threshold value is based on a value of a permissible current of the power line for the driving voltage;

the control driver to further apply the driving voltage simultaneously to a plurality of anode electrodes of the vacuum fluorescent display through the power line, the control driver includes an anode driver limiting section to perform a limitation on the number of the anode electrodes to which the driving voltage is applied simultaneously to less than a predetermined second threshold value, wherein the predetermined second threshold value is based on the value of the permissible current of the power line for the driving voltage; and the selecting section is adapted to control the grid driver limiting section to perform a limitation on the number of the grid electrodes to which the driving voltage is applied simultaneously to less than the predetermined first threshold value, and the selecting section is further adapted to control the anode driver limiting section to perform a limitation on the number of the anode electrodes to which the driving voltage is applied simultaneously to less than the predetermined second threshold value, and the selecting section is further adapted to control a limitation on the sum of the number of the grid electrodes and the number of the anode electrodes to which the driving voltage is applied simultaneously to less than a predetermined third threshold value, wherein the predetermined third threshold value is based on the value of the permissible current of the power line for the driving voltage.

2. The vacuum fluorescent display driving apparatus of claim 1, further comprising:

a storage section pre-stored with necessity data expressing the necessity of voltage application to the grid electrodes, according to display contents with the vacuum fluorescent display, wherein the grid driver limiting section is adapted to perform the limitation based on the necessity data stored in the storage section.

3. The vacuum fluorescent display driving apparatus of claim 2, wherein, based on the necessity data, the grid driver limiting section is adapted to limit the number of the grid electrodes to which voltage is applied simultaneously to zero, when the number of the grid electrodes to which the driving voltage is to be applied simultaneously by the voltage application section has become the predetermined first threshold value or greater.

4. The vacuum fluorescent display driving apparatus of claim 2, wherein the selecting section to select from the necessity data corresponding to the grid electrodes subject to limitation one at a time;

the grid driver limiting section includes:

a latch section including serially connected latch circuits, the latch circuits numbering the same number as the threshold value and in the latch section a predetermined value is latched in sequence from the most upstream the latch circuits every time the selected necessity data is data expressing voltage application; and a gate section adapted to interrupt an application of the driving voltage to the grid electrodes subject to limitation when the predetermined value has been latched in the most downstream of the latch circuits of the latch section.

5. The vacuum fluorescent display driving apparatus of claim 4, wherein the number of the latch circuits is one more than an upper limit of the number of grid electrodes that have been permitted to receive the driving voltage simultaneously.

6. The vacuum fluorescent display driving apparatus of claim 1, wherein the predetermined first threshold value is a predetermined number based on the size of current flowing in the power line due to application of voltage to the grid electrodes.

7. The vacuum fluorescent display driving apparatus of claim 1, wherein the vacuum fluorescent display is configured to display an image straddling a plurality of grids.

8. The vacuum fluorescent display driving apparatus of claim 1, further comprising:

a storage section pre-stored with necessity data expressing the necessity of voltage application to the grid electrodes and the anode electrodes, according to display contents with the vacuum fluorescent display;

a selecting section to select from the necessity data the necessity data corresponding to at least one of the grid electrodes and/or the anode electrodes subject to limitation one at a time;

a latch section including serially connected latch circuits, the latch circuits numbering the same number as the threshold value and in the latch section a predetermined value is latched in sequence from the most upstream the latch circuits every time the selected necessity data is data expressing voltage application; and a gate section to interrupt an application of the driving voltage to at least one of the grid electrodes and/or the anode electrodes subject to limitation when the predetermined value has been latched in the most downstream of the latch circuits of the latch section.

* * * * *